United States Patent [19]

Bunnelle

[11] 4,106,575

[45] Aug. 15, 1978

[54] TOOL STRING AND MEANS FOR SUPPORTING AND ROTATING THE SAME

[75] Inventor: Philip R. Bunnelle, Santa Clara, Calif.

[73] Assignee: FMC Corporation, San Jose, Calif.

[21] Appl. No.: 785,142

[22] Filed: Apr. 6, 1977

Related U.S. Application Data

[62] Division of Ser. No. 704,277, Jul. 12, 1976, Pat. No. 4,077,481.

[51] Int. Cl.[2] ..... E21C 45/00

[52] U.S. Cl. ..... 175/170; 173/22; 173/57; 173/164; 175/85; 175/215

[58] Field of Search ..... 173/57, 164, 163; 175/52, 85, 215, 67, 170, 213, 171, 173; 299/17

[56] References Cited

U.S. PATENT DOCUMENTS

| | | | |
|---|---|---|---|
| 3,005,504 | 5/1959 | Mayhew | 173/57 |
| 3,312,294 | 4/1967 | Wilson | 175/85 X |
| 3,623,558 | 11/1971 | Brown | 173/57 |
| 3,666,026 | 5/1972 | Allard | 173/163 |
| 3,747,696 | 7/1973 | Wenneborg et al. | 175/67 |

*Primary Examiner*—Ernest R. Purser

*Attorney, Agent, or Firm*—A. J. Moore; F. Ianno; C. E. Tripp

[57] ABSTRACT

Method and apparatus for subterranean slurry drilling and mining of granular ore, such as phosphates, with a combined drilling and mining apparatus. The apparatus includes a tool string having a drilling head and mining head that are selectively interchangeable on its upper end for drilling into one or more ore strata to be mined and thereafter to remove ore from the strata as a slurry. The drill string includes a plurality of inner and outer pipe sections connected to a drill bit at its lower end. A drilling/mining liquid is directed through the tool string during both the drilling and mining modes of operation. During drilling, liquid is directed through a foot valve into the rotating bit to wash cuttings to the surface externally of the tool.

22 Claims, 9 Drawing Figures

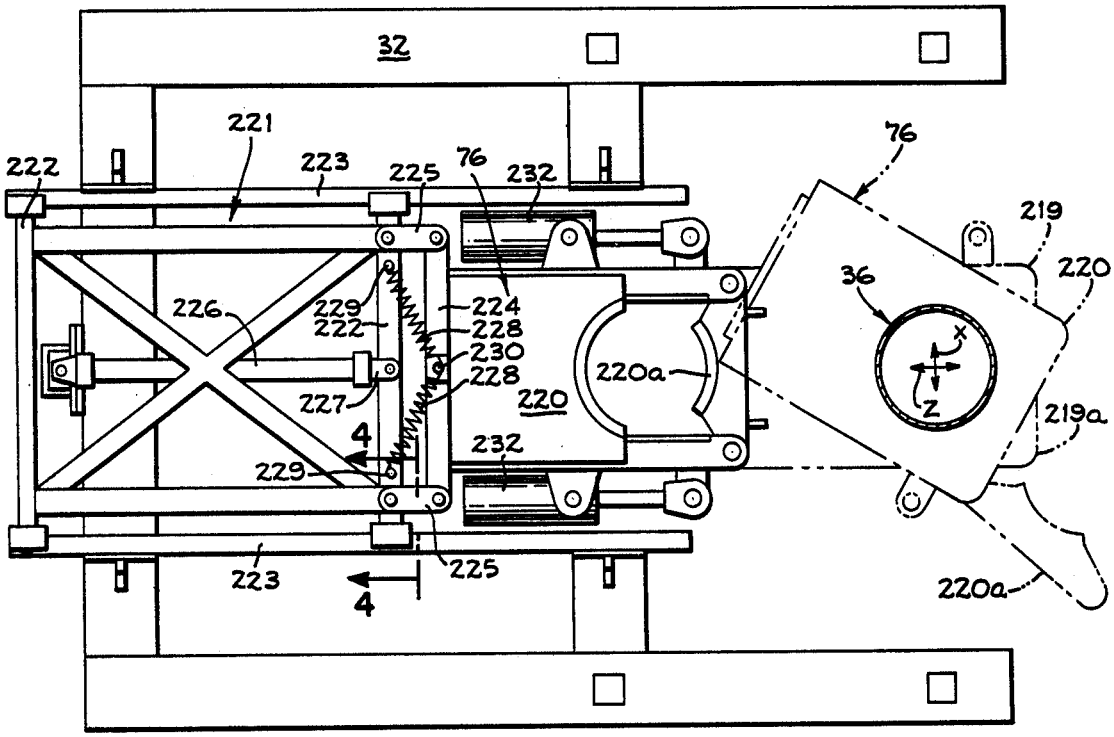
FIG_3
FIG_5
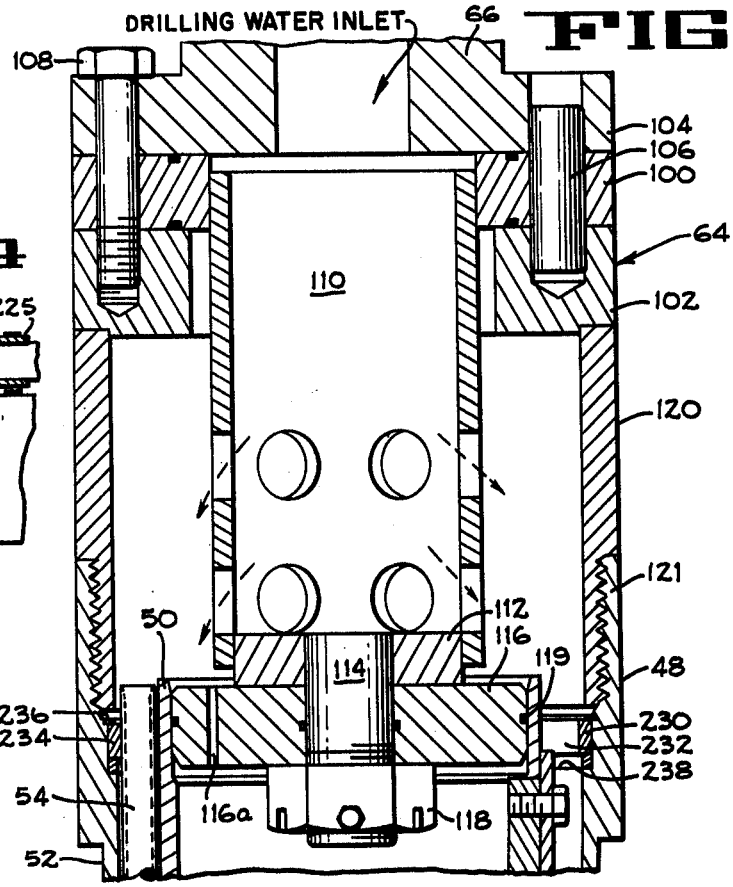
FIG_4
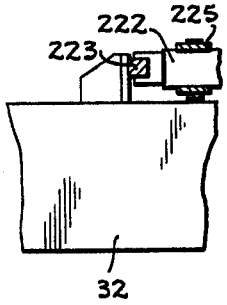

TOOL STRING AND MEANS FOR SUPPORTING AND ROTATING THE SAME

This is a division, of application Ser. No. 704,277 filed July 12, 1976 and now U.S. Pat. No. 4,077,481.

CROSS REFERENCE TO RELATED APPLICATION

My copending U.S. patent application Ser. No. 704,278, filed on even date herewith and assigned to the assignee of the present invention, discloses additional modified forms of the present invention, said application issuing as U.S. Pat. No. 4,059,166 on Nov. 22, 1977.

BACKGROUND OF THE INVENTION

1. Field of the Invention

This invention pertains to improvement in subterranean slurry mining and more particularly relates to an apparatus for drilling and mining one or more layers of granular ore, such as phosphates, without withdrawing the mining apparatus from the hole between the drilling and mining modes of operation.

2. Description of the Prior Art

Subterranean slurry mining of phosphates or the like is broadly known in the art as evidenced by Wenneborg et al. U.S. Pat. Nos. 3,730,592 and 3,747,696 which issued on May 1, 1973 and July 24, 1973, respectively, and are assigned to the assignee of the present invention. The disclosures of both of these patents are incorporated by reference herein.

The modified embodiment of the device disclosed in Wenneborg et al. U.S. Pat. No. 3,747,696 is the most pertinent prior art embodiment and comprises a combination slurry drilling and mining apparatus which may be changed between its drilling mode of operation and its mining mode of operation to mine several different layers of ore without requiring that the apparatus be pulled out of the hole or well. However, the hydraulic control system for changing the several valves from the drilling mode to the mining mode requires a positive pressure of about 2000 psig in the prior art device which is much greater than the approximately 1000 psig mining pressure. The prior art hydraulic control system thus requires additional high pressure pumping equipment, and is also subject to damage due to the very high control pressures and "water hammer" type forces which may be applied to the system.

Wenneborg et al. U.S. Pat. No. 3,730,592 discloses a method which contemplates the use of surface controlled pressures equal to or in excess of the drilling pressure for shifting the mining nozzle, the eductor nozzle, and the drill bit foot valve between the drilling mode and the mining mode. In addition, the patentee discloses the use of control pressures which lie in a range between the drilling pressure and the mining pressure for modulating the mining nozzle. Modulation of the mining nozzle is effective to control the cavity pressure, and also the liquid level in the mined cavity to vary the mining conditions for the particular strata being mined.

United States parent and divisional U.S. Pat. Nos. 3,155,177 and 3,316,985 which issued to A. B. Fly on November 3, 1964 and May 2, 1967, respectively, disclose a method and apparatus for under-reaming or slurry mining a well and can also be controlled to alternately bore deeper and mine other strata in the well after the first boring and mining operations have been completed. Valves operated by electric motors located within the tool string convert the apparatus from a drilling operation to a mining operation. The amount of force that can be applied to convert the apparatus from the drilling operation to the mining operation is, accordingly, limited by the size of the electric motors that can fit within the tool string.

SUMMARY OF THE INVENTION

In accordance with a first embodiment of the present invention a combined drilling and mining apparatus is provided. The combined apparatus comprises a double conduit tool string having a drill bit on its lower end, an eductor pump section and a mining nozzle section both of which are disposed within an ore bearing strata upon completion of the initial drilling operation, and a mining head connected through a swivel joint at the upper end of the tool string.

During drilling, a mining/drilling liquid (hereinafter referred to as water) is directed at about 300 psig (surface pressure) into a drilling head attached to a conventional vertically movable and rotatably driven power swivel. The water is directed through the outer annular conduit of the tool string and then passes through a tool bit foot valve into the tool bit. The water aids the drilling process and flushes the cuttings upwardly to the surface through the annular passage defined between the outer surface of the rotating tool string and the inner surface of the uncased drilled hole or well.

After the initial drilling has been completed, a mining head replaces the drilling head on the upper end of the pipe string and is connected thereto through a swivel joint to allow rotation of the tool string during mining. The mining head includes an inlet passage which enables the drilling/mining water to flow downwardly in the outer annular conduit of the tool string, and to allow a slurry of water and the granular ore being mined to flow upwardly through a generally cylindrical inner conduit in the tool string and out through a slurry outlet passage in the mining head for collection in any suitable collecting means such as a tank or pipeline to a processing plant.

A hydraulic control system is selectively controlled from the surface to maintain the drill bit foot valve open, the eductor pump nozzle closed and the mining nozzle closed during the drilling mode of operation; and to maintain the drill bit foot valve substantially closed, the eductor nozzle open, and the mining nozzle open during the mining mode of operation.

After the granular ore has been depleted from the mined matrix, the mining head is removed and the associated springs open the foot valve and close the mining and eductor nozzles thus returning the apparatus to its drilling mode. The hole or well cavity may then be drilled deeper, and additional pipe sections are then assembled in the tool string until the mining nozzle and slurry inlet are located in another ore matrix at which time the mining head is replaced and the control system is bled to return the nozzle plugs and foot valve to their mining positions. The new matrix is then mined and thereafter additional matrixes at different levels may be mined by alternately drilling deeper and mining the ore bearing matrixes disposed opposite the mining nozzle and eductor pump inlet at the different levels. It is also understood that the tool may first be drilled down to its lowest level, and can then alternately be raised to higher levels as it mines the several ore bearing matrixes.

It is therefore one object of the invention to provide a ratchet type drive for rotating the tool string during mining which allows the longitudinal axis of the string to freely shift laterally a limited amount in all directions thus minimizing the possibility of applying high bending loads on the tool string and preventing damage to the outer drive surface of the tool string by repeated frictional gripping of the same by conventional drive means.

Another object is to provide a mining head that is adapted to receive a hoist supported hydraulic power swivel and drilling head used for rotating the tool string during drilling for first screwing the mining head and its swivel joint on the upper end of the tool string, and for thereafter supporting the tool string during mining including the option of raising the string during mining thereby causing the jet of liquid discharged from the mining nozzle to contact the ore matrix at different levels making it possible to more effectively mine unusually deep matrixes.

BRIEF DESCRIPTION OF THE DRAWINGS

FIG. 3 is a top plan view illustrating a mechanism for supporting the torque wrench while allowing a small amount of relative movement between the barge and the tool string.

FIG. 4 is a section taken along lines 4—4 of FIG. 3.

FIG. 5 is a vertical section taken through a drilling head which is screwed into the upper end of each pipe section, in turn, as the well is being drilled; and is thereafter screwed into the top of the mining head for supporting the apparatus during mining, said view further illustrating the details of the upper end of standard pipe sections of the tool string.

DESCRIPTION OF THE PREFERRED EMBODIMENT

Figure 1:
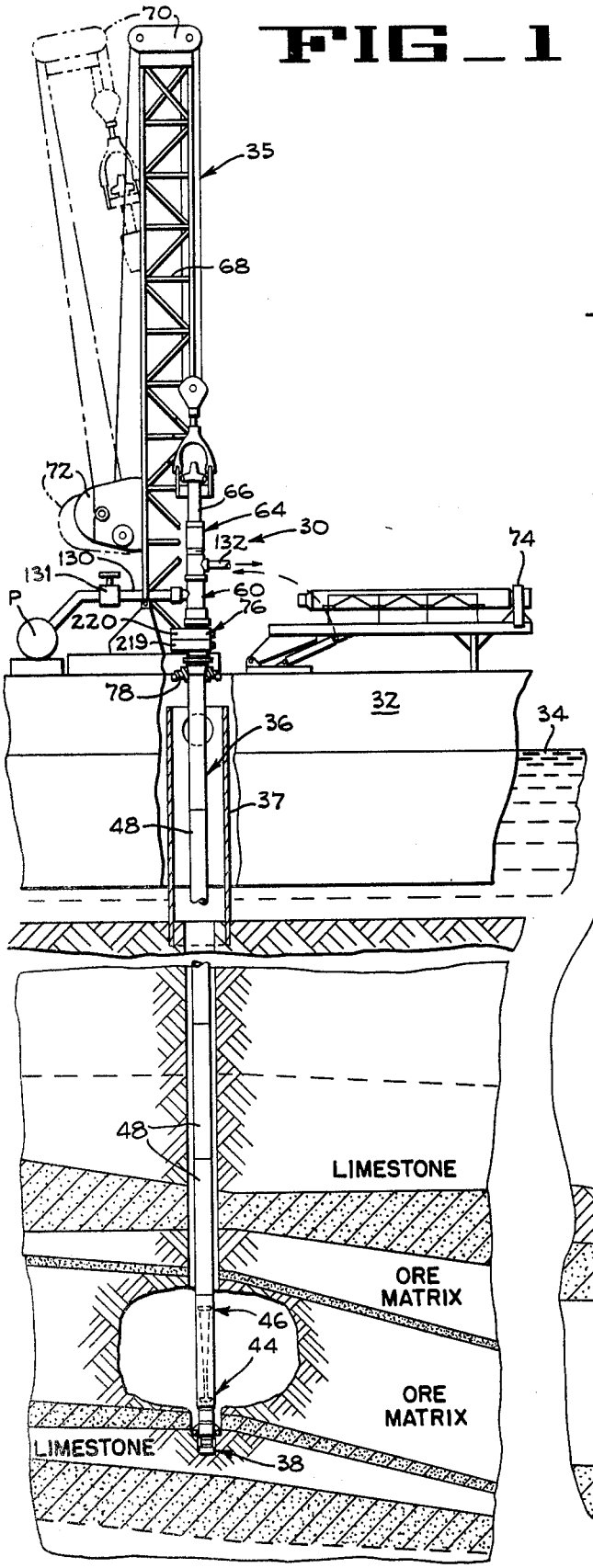
FIG. 1 is a diagrammatic elevation of one embodiment of the drilling and mining apparatus of the present invention shown supported from a barge and illustrated in its mining mode in a multi-stratum ore bed with one level being mined, several sections of the tool string being cut away to greatly foreshorten the height of the Figure.

The subterranean slurry drilling and mining apparatus 30 (FIG. 1) of the present invention is supported on a mobile vehicle such as a barge 32 floating in a pond 34 over the mining site. Conventional components of a well drilling rig 35 on the barge are employed during the drilling mode of operation to assemble the mining and drilling apparatus 30 section-by-section. Prior to drilling, the rig 35 is used to drive a large diameter conductor pipe 37 into the floor of the pond 34 to prevent the water in the pond from flowing into the well cavity. The apparatus is then operated in its mining mode to remove and collect a slurry of liquid and ore from the matrix being mined. After the reclaimable granular ore has been mined from one or more ore matrixes at the mining site, the apparatus is pulled from the well and is disassembled enabling the barge to move to another site.

Although the apparatus 30 is primarily intended for use in mining phosphates from one or more ore strata at depths between about 200 and 300 feet below the surface, it will be understood that the apparatus may be used at other depths for mining other types of ore including nonmetallic material. It will also be understood that the term "ore" as used herein includes gravel, rocks, or any other solids that the apparatus is capable of slurry pumping to the surface. It will also be understood that the apparatus is capable of handling ore as large as four inches in diameter although the normal consistency of the phosphate ore is somewhat like sand.

In general, the first embodiment of the drilling and mining apparatus 30, when fully assembled in its mining mode, includes a tool string 36 that extends downwardly through the conductor pipe 37 and has a conventional rotary drill bit assembly 38 at its lower end. It will be understood that the bit 38 includes lower cutters 40 and side cutters or underreamers 42 that cooperate to bore a hole or well cavity that is somewhat larger in diameter than the tool string. The side cutters 42 are pivoted inwardly when the tool is being pulled to the surface after the ore has been depleted from the mining site. An eductor pump section 44 is connected to the upper end of the drill bit 38, and the mining nozzle section 46 which includes a mining nozzle **46*a*, is connected to the upper end of the eductor section 44. A plurality of dual string pipe sections 48 (FIG. 1) are connected together and to the mining nozzle section 46 and extend upwardly to the surface. Each pipe section 48 includes an inner string conduit section 50 (FIG. 2) defining a tubular passage, an outer string conduit section 52 which with the inner section 50 defines an outer annular passage, a cavity pressure sensing control line or conduit 54, and a control line 56 which with the fluid pressure within the conduit 50,52 define a hydraulic control system 57 (FIG. 6), which system is fully disclosed in the parent application. The upper end of the uppermost pipe section 48 is connected to a swivel joint 58 that forms a portion of a mining head 60. The mining head 60 includes a threaded tool support coupling 62 that receives and is supported by a threaded swivel sub-assembly or drilling head 64**.

The drilling head 64 is supported by a hydraulically driven power swivel 66 (FIG. 1) of the well rig 35. The power swivel 66 is guided for vertical movement along the frame 68 of a drilling mast 70 and is raised and lowered by a power driven 100 ton cable hoist 72. The power swivel 66 and the hoist 72 are used to support the tool string 36 during the mining mode of operation and also for raising (or lowering) the tool string a limited amount while mining, if desired, in order to change the vertical location of a jet of water discharged from the mining nozzle for more effectively breaking up the granular ore matrix.

The drilling head 64 and power swivel 66 are also used as a unit to screw each section of the tool string 36 together and to direct water downwardly through the outer conduit 52 and through the drill bit during the drilling mode. Similarly, the drilling head and power swivel unit is used to unscrew the pipe sections of the tool string 36 from each other when the apparatus is being pulled from the well. During the drilling and pulling modes, a well known drill loading unit 74, torque wrench 76, and tool slip 78 cooperate with the power swivel 66 in a manner well known in the art to perform the drilling and pulling functions. It will also be noted that the mast 70 is pivotally connected to the barge 32 and may be pivoted away from the well as indicated in dotted lines to permit driving the conductor pipe 37 into the upper layer of soil prior to drilling.

In order to better appreciate the several features of the first embodiment of the drilling and mining apparatus of the present invention, the components of the apparatus will be described in detail in the order in which they appear in the apparatus from top to bottom.

DRILLING HEAD

As mentioned above, the drilling head 64 (FIG. 2) is screwed into the mining head 60 for supporting the apparatus 30 during mining, and is also screwed into each section of the tool string 36 during drilling to screw the several sections together and to direct water through the outer annular conduit 52 and into and through the drill bit 38 during the drilling operation.

The drilling head 64 (FIG. 5) includes an inner string flange 100 and an outer string flange 102 rigidly secured to an annular flange 104 of the power swivel 66 by a pair of centering pins 106 and cooperating cap screws 108. A water distribution tube 110 secured to the flange 100 is perforated to direct water laterally outward, and has its lower end closed by a disc 112 and a downwardly projecting threaded stub shaft 114. An annular plug 116 is rotatably mounted on the stub shaft 114 and is held in place by a cooperating lock nut 118. The plug 116 is inserted into each inner string conduit section 50 of the tool string during the drilling operation to prevent water from entering the inner tubular passage of the string except through a small bleed hole **116*a* provided in the plug 116 for establishing a small downward flow of water that will purge debris therefrom. O-rings or similar fluid seals 119** are positioned between mating parts to prevent leakage of water therepast when at its drilling pressure of about 300 psig.

An outer hardened pipe section 120 is welded to the outer flange 102 and has an externally threaded lower end which is threaded into the box end 121 of each outer pipe section 48 during the drilling operation. During assembly and disassembly of the several sections of the tool string 36, relatively moveable upper and lower pipe gripping jaws of the torque wrench 76 (FIG. 1) firmly grip the outer surface of the pipe section 120 and the associated box end 121, respectively, to aid the power swivel 66 in tightly connecting (or disconnecting) the several sections of the tool string together. As will become more apparent hereinafter, the inner conduit sections 50 (FIG. 5) of the several interconnected sections of the tool string 36 remain stationary while the outer sections 52 rotate when each outer section is being screwed into or out of the next lower section. The stub shaft 114 of the drilling head is also rotated when screwing the outer sections into or out of the next lower section. Thus, the rotatable mounting of the plug 116 relative to the stub shaft 114 prevents relative motion and possible galling between the outer periphery of the plug 116 and the inner annular sealing surface of the box ends of each inner conduit 50.

MINING HEAD 60

The mining head 60 (FIG. 6) is used during the mining mode and at that time is disposed below the crane supported power swivel 66 and drilling head 64, and above the rotatable tool string 36 to permit the tool string 36 to rotate while the upper portion of the mining head is held from rotation. The head 60 (FIG. 6) includes a water inlet conduit 130 (FIG. 1) connected to outer conduit 52 supplied by a pump P and controlled by a valve 131; a slurry outlet elbow 132 coupled with inner conduit 50; and two control line outlets 134 (only one outlet being shown in FIG. 6) connected to control lines 54 (only one control line being shown in FIG. 6), all of the above conduits being in fluid sealed relationship relative to each other.

Figures 6, 6A:
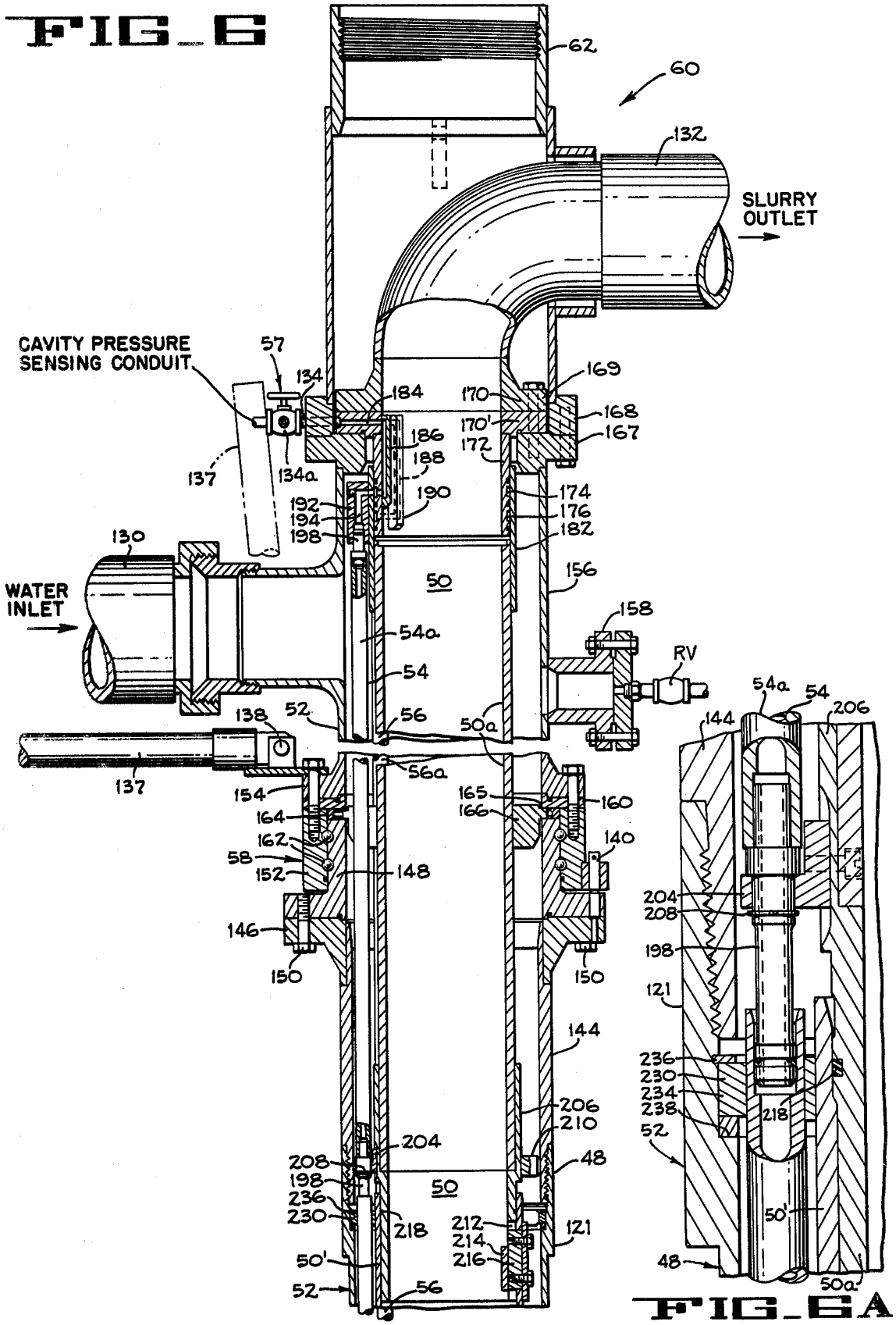
FIG. 6 is an enlarged vertical central section taken through the mining head of the apparatus of FIGS. 1 and 2 illustrating its specific details of construction.
FIG. 6A is an enlarged sectional view of a portion of a pipe section joint illustrating structure for centering the inner and outer pipe strings and for coupling the control lines.

The swivel joint 58 (FIG. 6) of the mining head 60 permits rotation of the tool string during mining while the outer portion of the head above the swivel joint is held from rotation by a torque arm 137 pivotally connected to the head by a pin 138 for movement between the solid line and dotted line positions in FIG. 6. Prior to the mining operation, the swivel joint 58 and upper portion of the head are locked from relative rotation by a shear pin 140 thus permitting the mining head to be screwed onto the uppermost pipe section by means of the power swivel 66 and drilling head 64 as previously described.

The mining head 60 includes a hardened pipe sleeve 144 which is screwed into the box end 121 of the outer conduit 52 of the uppermost pipe section 48 and may be engaged by the pivotal clamp jaws or dies of the torque wrench 76 (FIG. 1) (or by other drive mechanisms to be described hereinafter) to rotate the tool string in approximately 15° increments each five minutes during mining.

The sleeve 144 is welded to a pipe flange 146 that is connected to the flanged inner ball race 148 of the swivel joint 58 by capscrews 150. The outer ball race 152 is connected to the lower flange 154 of a pipe tee 156 by cap screws with an annular swivel ring bushing 160 sandwiched therebetween. In order to support the upper section **50*a* of the inner string 50 from axial movement relative to the outer string 52 and to seal the balls 162 of the swivel joint from the mining liquid, an annular chevron type seal 164 and the flange or lugs 165 of a collar 166 welded to the inner string 50 are rotatably received between the swivel ring 160 and the upper edge of the inner ball race 148**.

Figure 2:
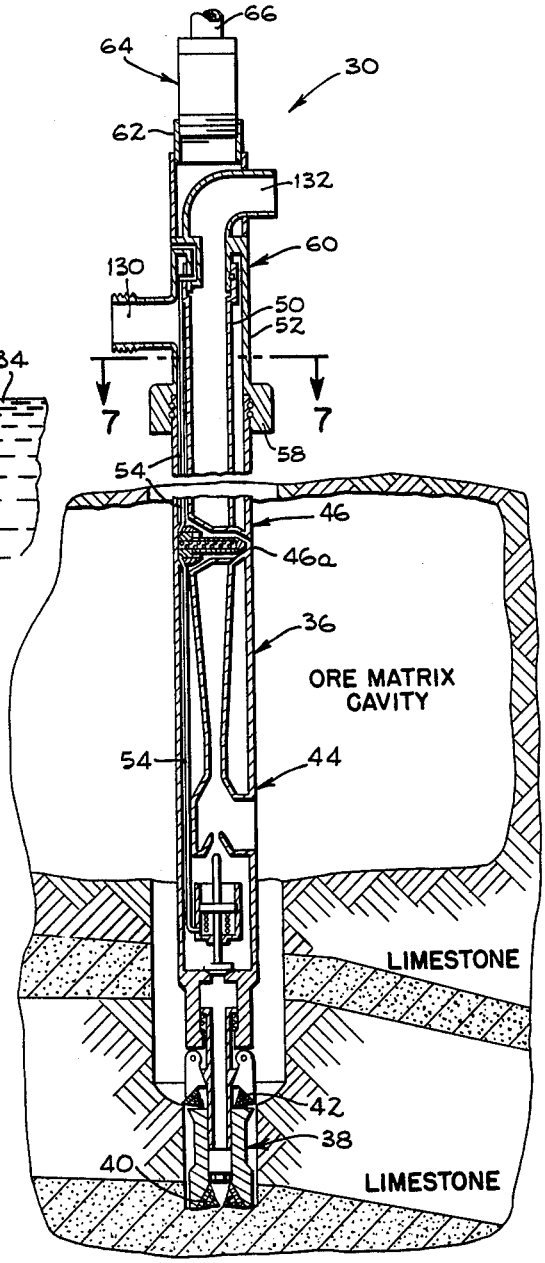
FIG. 2 is a diagrammatic vertical central section taken at a larger scale illustrating the several components of the tool string at a larger scale, several sections of the tool string being cut away to reduce its illustrated height.

The large pipe tee 156 which is connected to the water inlet conduit 130 also includes a flanged connector 158 to which a relief valve (or rupture disc) RV is connected. A flange 167 at the upper end of the pipe tee 156 is rigidly connected by cap screws to the flange 168 of the previously referred to threaded tool support coupling 62 which receives the tool supporting drilling head 64 (FIG. 2). A flange 169 (FIG. 6) on the slurry outlet elbow 132 is connected by capscrews to the flange 167, and has a ported annular flange 170' of an inner string and control line gland 170 clamped therebetween in fluid tight engagement. The gland 170 includes an inner sleeve 172 having an upper annular control system groove 174 and a lower annular control groove 176 along with three annular seal ring grooves formed in its outer periphery. Suitable well known seal rings are placed in the seal ring grooves to seal against the inner surface of a sleeve 182 rigid with a portion of the inner string section 50*a* thereby sealing the control system grooves 174 and 176 in fluid tight engagement from each other and from the inlet water and outlet slurry passages in the apparatus.

Cavity pressure sensing line outlet 134 of control line 54 communicates with the upper control system groove 174 through passage 184. A portion of the passage 184 is formed in a block 186 welded in fluid tight engagement to the inner surface of the sleeve 172. Similarly, the nozzle control line outlet of control line 56 communicates with the lower control system groove 176 through passages 188 (shown in dotted lines in FIG. 6), a portion of which is formed in a long block 190 welded to the inner surface of the sleeve 172.

A control line connector block 192 is welded to the outer surface of the sleeve 182 and includes flow passage 194 which communicates with the passage 184. The upper male end of the upper section 54*a* of the cavity pressure control or sensing line 54 is received in the passage 194 during assembly of the mining head 60 to define a bayonet type or stab connector 198 which is maintained in fluid tight engagement by an O-ring.

Similarly, a block (not shown) which is identical to the block 192 is welded to the sleeve 182 and establishes a communication between the passage 188 and the upper section of the nozzle control line 56. The upper section of the nozzle control line includes a male end portion of a bayonet connector similar to connector 192 which is stabbed in fluid tight engagement with its mating female portion.

Like the upper ends, the lower end portions of the control line sections 54*a* and 56*a* are both connected to the next lower section of control lines 54 and 56 by bayonet type connectors 198 (FIGS. 6 and 6A). The lower ends are accurately positioned relative to the inner pipe string 50 by apertured brackets 204 (only one being shown) rigidly secured to a flanged sleeve 206 that forms the male end of the inner pipe section 50*a*. The lower or male end of each control line 54 and 56 are held from axial displacement relative to the brackets 204 by large diameter portions of the control lines 54 and 56 and cooperating snap rings 208. The lower end of the inner string section 50*a* maintained in coaxial alignment with the outer string 52 by a plurality (preferably three) of equally spaced ears 210 welded to the sleeve 206 and slidably engaging the inner surface of the sleeve 144 of the outer string.

The lower end of the inner sleeve 206 is provided with a slot 212 (FIG. 6) having a strengthening strap 214 welded across its inner surface. A key 216 bolted to the upper end of the inner section 50' of the next lower pipe section is received in the slot 212 thus preventing rotation between the two inner sections. An O-ring 218 seals the two inner pipe sections 50*a* and 50' together in fluid tight relationship.

TORQUE WRENCH 76

The torque wrench 76 is of standard design, identified as Varco Torque Wrench 250 manufactured by Varco International, Inc., 800 North Eckhoff Street, Orange, California 92668, and accordingly the details of the wrench will not be described. It will suffice to say that the torque wrench includes a lower gripping assembly 219 (FIGS. 1 and 3) and an upper gripping assembly 220 both of which include pivotal gates 219*a*, and 220*a* which gates may be pivotally opened to receive the tool string and thereafter independently closed into frictional clamping engagement with the several sections of the tool string 36. After being positioned around the tool string, the upper gripping assembly 220 may be pivoted through an angle up to about 27° relative to the non-rotatable lower gripping assembly 219 to either tighten or unscrew the several sections of the tool string 36 from each other, or to intermittently rotate the tool string 36 during mining.

Although the details of the torque wrench per se are not critical to the present invention, the structure for mounting the torque wrench on the barge 32 does form a part of the invention since it provides means of relieving bending forces on the tool string due to relative movement between the barge 32 and the tool string 36. In this regard, the barge, although anchored, tends to drift small amounts relative to the tool string 36, and also tends to roll about the longitudinal axis of the barge and pitch to a lesser extent about the transverse axis of the barge.

Having reference to FIG. 1, it will be apparent that the drill bit 38 at the lower end of the tool string 36 is held at the bottom of the drill hole from any substantial transverse movement and that the drill head 64 and power swivel 66 determines the position of the upper end of the string since the power swivel is slidably guided by the frame 68 of the mast 70. Thus, rolling, pitching or lateral movement of the barge 32 relative to the drill hole or well will cause the upper portion of the tool string 36 to move laterally relative to the torque wrench 76 if the torque wrench is rigidly secured to the barge 32. Although the transverse movement relative to a fixed torque wrench would be only a few inches, the bending force applied to the tool string between its upper and lower ends would become dangerously high unless the torque wrench 76 is permitted to freely center itself relative to the longitudinal axis of the tool string 36.

Accordingly, the torque wrench 76 is supported by a carriage 221 (FIG. 3) having U-shaped end portions of transverse beams 222 slidably received on slide bars 223 (FIGS. 3 and 4) that are rigidly supported on the barge 32 and extend longitudinally thereof. A cross-beam 224 rigid with the lower gripping assembly 219 is pivotally connected to the carriage 221 by parallel links 225. One end of a carriage advancing hydraulic cylinder 226 is pivotally connected to the barge frame while its piston rod 227 is pivotally connected to one of the transverse beams 222. Springs 228 are connected between pins 229 on the beam 222 and a pin 230 on the cross bar 224 to center the torque wrench 76 when the wrench is not in engagement with the tool string 36. Thus, the cylinder 226 when activated moves the torque wrench 76 between the solid line position (FIG. 3) at which time the wrench is in an inoperative position spaced from the tool string 36, and the operative tool engaging position illustrated in dotted lines with the upper gripping assembly 220 being shown in a pivoted position relative to the lower assembly 219.

After the torque wrench 76 has been clamped around the tool string 36, the valve (not shown) controlling the hydraulic cylinder 226 is placed in a neutral position permitting free movement of the piston rod 227. The parallel pivot links 225 will accommodate transverse misalignment of the tool string 36 and torque wrench 76 clamped thereon relative to the barge in the direction indicated by arrows X (FIG. 3). The freedom of movement of the piston rod 227 within the cylinder 226 accommodates longitudinal misalignment of the tool string 36 and torque wrench 76 relative to the barge 32 in the direction indicated by arrow Z (FIG. 3). Thus, the structure for supporting the torque wrench permits the torque wrench to perform its several functions without applying a bending force on the tool string 36 due to misalignment between the barge 32 and the tool string 36.

As mentioned above, the upper gripping assembly 220 may be pivoted through an angle of 27° (or any smaller angle) in either direction relative to the lower gripping assembly 219 by hydraulic cylinders 232. Other hydraulic cylinders (not shown) in each assembly are independently activated to alternately clamp and release the threaded joints between the several tool sections when the sections are being screwed together or are being unscrewed. When the torque wrench 76 is being used to intermittently index the tool string 36 during mining, the lower assembly is loosely received around the string and the jaws of the tool slip 78 are released from gripping engagement with the tool string. The upper gripping assembly 220 is clamped in gripping engagement with and rotates the tool string about 15° in about 5 seconds and is then loosened for approximately 5 minutes at which time it is again clamped to repeat the cycle of operation. It will be understood, however, that the tool string 36 may be rotatably indexed through different angular ranges for different time intervals if desired.

As indicated previously in the general description of the illustrated embodiment of the invention, the drilling head 64 (FIG. 1), which head is connected to the power swivel 66 and is supported by the hoist 72, is used without the mining head 60 when coupling and uncoupling the several sections of the tool string 36 together; and is used with the mining head during mining. During drilling the power swivel provides the power to rotate the tool string 36, and during mining the torque wrench 76 provides the driving means for rotating the tool string 36.

It will be understood, however, that if desired, the drilling head and mining head may be combined as a unit and used during drilling as well as during mining. When used in this fashion, the power swivel 66 serves only to suspend the tool string 36, and all rotative power is provided by drive means such as the torque wrench 76 or the drive means illustrated in the second embodiment of the invention described in Wenneborg et al. U.S. Pat. No. 3,730,592. As previously mentioned, this Wenneborg et al patent is assigned to the assignee of the present invention and is incorporated by reference herein. During drilling, the tool string should be driven at a rate of about 50 – 60 rpm; and during mining the tool string may be driven either continuously or intermittently but preferably at a much slower speed.

DUAL STRING PIPE SECTIONS 48

Since the mining nozzle section 46 and the educator pump section 44 must be aligned with the particular ore strata being mined, and since the mining occurs between the 200 and 300 foot levels, the plurality of pipe sections 48 (FIG. 1) are not all the same length but are made in sections which vary in length between 10 feet and 20 feet. Thus, the length of the pipe sections 48 may be preselected and assembled together so as to provide a total length which will properly locate the mining nozzle 46*a* and the inlet of the eductor pump section 44 in the matrix being mined.

Although the inner string and outer string portions of the mining nozzle section 46 and the eductor nozzle section 44 are rigidly secured together as will be made apparent hereinafter, it will be understood that the outer section 52 of each standard pipe section 48 is rotated relative to both its inner section 50 and the two control lines 54 and 56 during assembly or disassembly of the tool string 36. Such relative rotation between the inner and outer sections permits the outer sections 52 to be interconnected by screw threads, which when compared to flanged connections is a much faster and less expensive method of connecting pipe sections together, while the several inner pipe sections 50 and the control lines 54 and 56 are coupled together by stab-type connections.

For ease in handling each dual string pipe section 48, the upper end of the inner section 50 is held in axial alignment with, and from axial displacement relative to, the outer section 52 by conventional means which includes a ring 230 (FIGS. 5 and 6A). The ring 230 is rigidly secured to the inner section 50 by a plurality of radial ears 232 (only one being shown in FIG. 5) and include a pair of apertured portions 234 (only one being shown), for slidably receiving and accurately locating the upper end of the associated sections of the control lines 54 and 56. The ring 230 is rotatably received in the outer section 52 and is held from axial displacement relative thereto between a snap ring 236 secured to the outer section and a thrust bushing held by a shoulder 238 formed in the outer section.

The lower end of each pipe section 50 is centered relative to the outer section 52, and the control lines 54 and 56 are held in place by ears and brackets similar to the ears 210 and the brackets 204 (FIG. 6). It will be apparent that the act of screwing the outer sections together will also cause the inner sections to move axially toward and into sealing relationship with each other. Thus, the joints between each dual pipe section 48 is the same as the joint between the sleeve 144 (FIG. 6) and the adjacent lower pipe section 48.

ROTARY DRILL BIT 38

The rotary drill bit 38 (FIG. 2) may be of any well known type which includes lower cutters 40 and pivotal side cutters or underreamers 42 that collapse within the body of the bit when the tool is being lifted from the well. A suitable underreamer is manufactured by Servco, P.O. Box 20212, Long Beach, CA and is known as the Servco Series 15000 Rock Type Underreamer. The underreamer is connected to the lower cutters 40 which are of the type manufactured by Hughes Tool Company,

ALTERNATE TOOL STRING ROTATING DEVICE 610

As mentioned previously, the tool string 36 (FIGS. 1 and 2) is rotated or indexed approximately 15° every 5 minutes by the torque wrench 76 (FIGS. 3 and 4) thereby causing the jet of water from the mining nozzle 46*a* to contact different areas of the ore matrix being mined. Also, as mentioned previously, the repeated engagement and disengagement of the jaws of the torque wrench 76 with the sleeve 144 (FIG. 6) of the mining head 60 damages the outer surface of the sleeve thus requiring occasional replacement of the sleeve.

Figure 7:
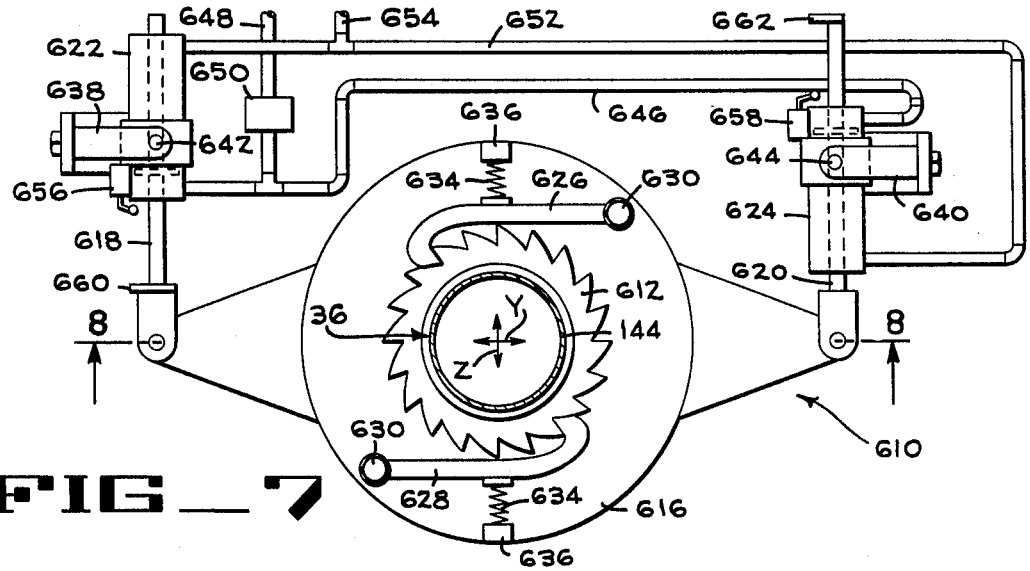
FIG. 7 is a horizontal section taken at the plane indicated by lines 7—7 of FIG. 2, illustrating an alternate ratchet drive for rotating the tool string during mining.
Figure 8:
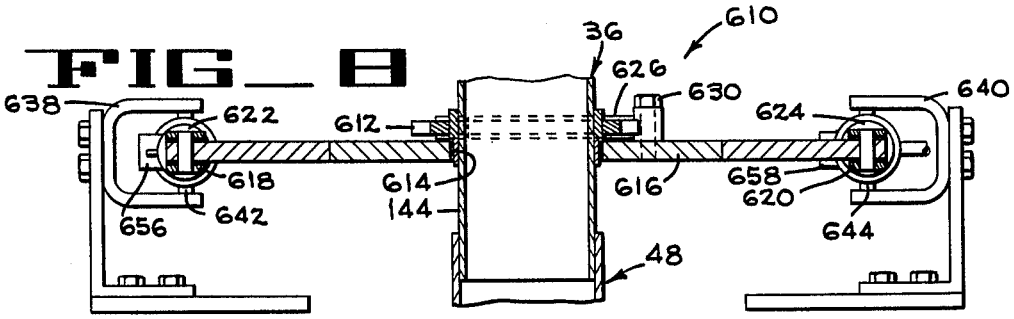
FIG. 8 is a section taken along lines 8—8 of FIG. 7 transversely of the barge.

An alternate tool string rotating device 610 (FIGS. 7 and 8) comprises a ratchet gear 612 which is welded or splined to the sleeve 144 of the mining head 60. When the mining head 60 is to be assembled on the uppermost pipe section, the sleeve 144 is first lowered through a clearance hole 614 in disc 616 having a pair of ears projecting outwardly therefrom and pivotally connected to the piston rods 618,620 of hydraulic cylinder 622 and 624, respectively. A pair of ratchet pawls 626 and 628 are pivoted to the disc 616 by shouldered cap screw 630 and are urged into engagement with the teeth 632 of the ratchet 612 by compression spring 634 disposed between the associated pawls and blocks 636 welded to the disc 616.

A pair of trunnions 638 and 640 are rigidly secured to the previously described carriage 221 (FIG. 3) and support the hydraulic cylinders 622 and 624, respectively, for pivotal movement about the axes of pivot pins 642 and 644, respectively. The high pressure or driving ends of the hydraulic cylinders 622 and 624 are interconnected by a conduit 646 which is connected by a main conduit 648, having a solenoid valve 650 therein, to a hydraulic system (not shown). Similarly, a second conduit 652 connects the other ends of the cylinders 622 and 624 together into a second main conduit 654 of the hydraulic system. Thus, slight transverse misalignment of the barge relative to the tool string 36 as indicated by the arrows Y (FIG. 7) is compensated for by pivotal movement about pivot pins 642 and 644. Longitudinal misalignment as indicated by the arrows Z is compensated for by different amounts of retraction and extension, respectively, of the piston rods 618, 620 during the power stroke which occurs because equal pressure will be applied to both piston rods since they are interconnected by conduit 646. Because the strokes of the two piston rods 618 and 620 will not be the same when compensating for misalignment in the direction of arrow Z, and because very high side loads will result if one piston bottoms before the other, the power to both cylinders must be shut off by closing the solenoid valve 650 when the first piston bottoms out. To close the valve 650, limit switches 656 and 658 are mounted on the cylinders 622 and 624, respectively, and are positioned to engage stops 660 and 662 secured to the piston rod 618 and 620, respectively. The switches 656 and 658 are connected in parallel between an electrical power source and the solenoid valve 650. Therefore, the first switch to engage its stop will close the valve 650 thereby completing the indexing of the tool string. Low pressure may be directed through the conduit 654,652 to the other ends of the cylinders to return the piston rods 618 and 620 to their starting positions illustrated in FIG. 7.

If it is desired to change the angular degree of rotation of the tool strings, the position of the stops 660, 662 on the piston rods may be adjusted. It will also be understood that the misalignment between the tool strings 36 and the barge 32 in a direction longitudinally of the barge as indicated by arrow Z (FIGS. 3 and 7) may be partially compensated for by placing the piston rod 227 (FIG. 3) of the hydraulic cylinder 226 which operates the carriage 221 in the free moving neutral position.

OPERATION

Although the operation of the several components of the drilling and mining apparatus 30 (FIGS. 1 and 2) has been included in the detailed description of the component, a summary of the operation of the first embodiment of the invention will follow having reference primarily to FIGS. 1 and 2.

The barge 32 is first moved to the mining site and is anchored in desired position and the conductor pipe 37 is driven into the bottom of the pond 34. The well drilling rig 35 is then used in conjunction with the drill loading unit 74, the torque wrench 76, and the tool slip 78 to assemble the apparatus 30 section by section while drilling the hole or well. During the drilling and assembly operation, the mining head 60 is stored on the deck, and the drilling head 64 is screwed into the upper end of each section of the tool string 36 to thread the outer conduit section 52 together while causing the non-rotatable inner sections 50 to move axially into sealing engagement with each other. The power swivel 66 provides the initial torque required to screw the eductor section 44, the mining section 46 and the plurality of double string pipe sections 48 together. Final high torque tightening of the threads interconnecting each section is provided by the torque wrench 76. After each section is firmly secured to the next lower section, the power swivel 66 acts through the mining head 64 to rotate the drill bit 38 thus drilling the hole.

During drilling after each section of the tool string 36 has been assembled, water at a surface pressure of about 300 psig is directed through the power swivel 66, the drilling head 64 (FIG. 2) and the annular passage between the outer conduit 52 and the inner conduit 50. At this time control conduits 54 and 56 are open to the drilling pressure, as indicated in FIG. 6, thus preventing the drilling water from flowing through both the nozzle of the eductor pump section and the mining nozzle **46*a***.

The several pipe sections 48 vary in length between about 10 and 20 feet and are so selected that after assembly of the last pipe section 48 on the tool string 36, mining nozzle **46*a* and the eductor pump 44 are positioned in the ore bearing strata or matrix to be mined as indicated in FIG. 2. The mining head 60 is then moved by a crane into position to be received and supported by the drilling head 64. The power swivel 66 then screws the drilling head 64 into the mining head 60 and the mining head 60 into the uppermost pipe section 48. The shear pin 140 (FIG. 6) between the upper portion of the mining head 60 and its swivel joint 58 is then removed and the torque arm 137 is pivoted to its solid line position against a leg of the drill rig 35 to hold the upper portion of the mining head from rotation. The water inlet conduit 130 and slurry outlet conduit 132, which conduits preferably include long flexible portions (not shown), are then connected to the mining head 60** thus placing the apparatus in its mining mode of operation.

During mining, the hoist 72, power swivel 66 and drilling head 64 which is screwed into the mining head 60 supports the entire apparatus 30 without the aid of the tool slip 78. During mining, the torque wrench 76 (or the alternate tool string rotating device 610 FIG. 7) intermittently indexes or rotates the string below the swivel joint 58 at a rate determined to be most suitable for the particular type of ore strata being mined. For example, rotation of about 15° every five minutes has been found desirable for certain ore bearing strata which is of sandy consistency. During this time the structure for mounting the torque wrench 76 (or alternate device 610) will compensate for misalignment between the tool string 36 and the barge 32. If helpful to dislodge the ore from the matrix being mined, the hoist 72 may also be used to raise or lower the entire tool string several feet during mining to more effectively direct the jet of water from the mining nozzle **46*a*** against the ore matrix to reduce the ore to a slurry.

When the ore within the range of the jet of water discharge from the mining nozzle has been depleted in the particular matrix being mined, the apparatus may be returned to its drilling mode and either drilled deeper or raised to another matrix level by adding or removing pipe sections without requiring that the entire apparatus be removed from the hole. Before changing from the mining to the drilling mode, the pump P (FIG. 1) is turned off. The mining head 60 is then removed and the drilling head is screwed into a pipe section to be added or removed from the tool string 36.

From the foregoing description it will be apparatus that it is within the scope of the present invention to provide drilling and mining apparatus having a tool string connected to a mining head. During mining the entire tool string below a mining head swivel joint is intermittently rotated to direct a jet of water from the mining nozzle against different portions of the ore matrix being reduced to a slurry. During rotation, means are provided to minimize any unbalanced side loads on the tool string.

Although the best mode contemplated for carrying out the present invention has been herein shown and described, it will be apparent that modification and variation may be made without departing from what is regarded to be the subject matter of the invention.

I claim:

1. In a subterranean drilling and mining apparatus operable to both drill into subterranean deposits of ore and to mine the ore as a slurry; including a multi-section tool string having means defining an inner conduit and means defining an outer conduit, and a drill bit at the lower end of the tool string; the improvement which comprises a mining head connected to the upper end of said tool string during mining, a drilling head separate and independent from said mining head during drilling and adapted to be connected to each upper section of the tool string in turn during drilling and to the upper portion of the mining head during mining, first power means connected to said drilling head for supporting said tool string for vertical movement and for rotating said drilling head and tool string during drilling, and second power means for rotating only the outer conduit of each upper section in turn when adding sections to or removing sections from the portion of the tool string therebelow, said second power means rotating both said inner and outer conduit means of said tool string along with a portion of said mining head during mining.

2. An apparatus according to claim 1 wherein said mining head includes an upper portion and a lower portion connected together by a swivel joint.

3. An apparatus according to claim 1 wherein the mining apparatus is supported by a mobile vehicle, and means for connecting said second power means to the mobile vehicle independently of the heads for self centering movement relative to the longitudinal axis of the mining and/or the drilling head and said tool string when said second power means is secured in driving engagement to said tool string at a point intermediate the ends thereof for minimizing unbalanced forces from being applied to the tool string during rotation due to misalignment between the axis of the tool string and the vehicle.

4. An apparatus according to claim 3 wherein said second power means includes a gripping assembly pivoted through a predetermined range, said means for connecting said second power means to said mobile vehicle including means for supporting said gripping assembly for movement between a position remote from the tool string and a position aligned therewith, jaws on said gripping assembly which frictionally grip a portion of the tool string or mining head when the assembly is pivoted in one direction and which can be caused to release the tool string from rotation when pivoted in the opposite direction.

5. An apparatus according to claim 4 wherein said gripping means is preferably pivoted through a range of about 15° every five minutes during mining.

6. An apparatus according to claim 1 wherein said second power means includes a ratchet secured to a rotatable portion of said tool string for rotation therewith, ratchet pawls engageable with said ratchet, and means for moving said ratchet pawls through a predetermined arcuate range for intermittently rotating said tool string.

7. An apparatus according to claim 6 wherein said means for moving said ratchet pawls include a pair of hydraulic cylinders and pistons pivotally connected between the mobile vehicle and the pawls, means for equalizing the hydraulic pressure acting on both cylinders when rotating said tool string, and control means for terminating the application of pressure when either of said pistons moves a predetermined distance thereby minimizing the application of unbalanced driving forces on said tool string.

8. In a subterranean drilling and mining apparatus operable to both drill into subterranean deposits of ore and to mine the ore as a slurry; including a multi-section tool string having means defining an inner conduit and means defining an outer conduit, and a drill bit at the lower end of the tool string; the improvement which comprises a mining head connected to the upper end of said tool string during mining, a drilling head connected to the upper section of the tool string during drilling, first power means connected to said drilling head for supporting said tool string for vertical movement and for rotating said drilling head and tool string during drilling, second power means for rotating both said inner and outer conduit means of said tool string and a portion of said mining head during mining, said mining head including an upper portion and a lower portion connected together by a swivel joint, said drilling head being connected to the mining head during mining, and a removable pin maintaining said upper and lower portions of said mining head from relative rotation during assembly on the upper section of said tool string, said first power means being effective to rotate said mining head for screwing said mining head onto said outer conduit means prior to removal of said pin.

9. In a subterranean drilling and mining apparatus operable to both drill into subterranean deposits of ore and to mine the ore as a slurry; including a multi-section tool string having means defining an inner conduit and means defining an outer conduit, and a drill bit at the lower end of the tool string; the improvement which comprises a mining head connected to the upper end of said tool string during mining, a drilling head connected to the upper section of the tool string during drilling, first power means connected to said drilling head for supporting said tool string for vertical movement and for rotating said drilling head and tool string during drilling, second power means for rotating both said inner and outer conduit means of said tool string and a portion of said mining head during mining, said drilling head including an annular plug journaled thereon, said drilling head when connected to said first power means and to the uppermost outer conduit section having said plug seated in liquid sealing engagement within the upper end of the uppermost inner conduit section, and means for directing liquid into said drilling head during the drilling mode, said plug being effective to substantially prevent flow of liquid into said inner conduit section during drilling.

10. An apparatus according to claim 9 wherein said annular plug includes means defining a bleed hole therethrough for directing a small quantity of liquid into said inner conduit for minimizing the accumulation of debris in the inner conduit during drilling.

11. In a subterranean drilling and mining apparatus supported by a mobile vehicle and operable to both drill into subterranean deposits of ore and to mine the ore as a slurry; including a multi-section tool string having means defining an inner conduit and means defining an outer conduit, and a drill bit at the lower end of the tool string; the improvement which comprises means defining a fluid transmitting head having a liquid inlet passage and a slurry outlet passage therein, said head including a swivel joint connected between a non-rotatable upper portion and a rotatable lower portion, said lower portion of said head being connected to the upper end of said tool string during drilling and mining, power lifting means connected to said upper portion of said head for supporting said tool string for vertical movement during drilling, second power means connected to said head for rotating said tool string and said lower portion of said head during drilling and mining, third power means for rotating said tool string and said lower portion of said head during mining, and means for connecting said third power means to the mobile vehicle for self centering movement relative to the tool string for minimizing unbalanced forces from being applied to the tool string during rotation due to misalignment between the axis of the tool string and the vehicle.

12. An apparatus according to claim 11 wherein said third power means includes a gripping assembly pivoted through a predetermined range, jaws on said gripping assembly which frictionally grip said lower portion of the head or upper portion of the tool string when the assembly is pivoted in one direction and which can be caused to release the head or tool string when pivoted in the opposite direction.

13. An apparatus according to claim 11 wherein said third power means includes a ratchet secured to said lower rotatable portion of said head for rotation therewith, ratchet pawls engageable with said ratchet, and means for moving said ratchet pawls through a predetermined arcuate range for intermittently rotating said tool string.

14. An apparatus according to claim 13 wherein said means for moving said ratchet pawls include a pair of hydraulic cylinders and pistons pivotally connected between the mobile vehicle and the pawls, means for equalizing the hydraulic pressure acting on both cylinders when rotating said tool string, and control means for terminating the application of pressure when either of said pistons moves a predetermined distance thereby minimizing the application of unbalanced driving forces on said tool string.

15. In a subterranean drilling and mining apparatus mounted on a vehicle and including a tool string having a lower end and an upper end, a tool string rotating device comprising: means for alternately gripping and thereafter releasing the tool string at a point intermediate its lower end and said point of suspension, power means for pivoting said tool string gripping means and the gripped tool string through an arcuate range and for thereafter releasing said tool string gripping means while returning the gripping means to the starting position, and means connecting said power means to said vehicle for self-centering movement relative to the vehicle when said power means is secured in driving engagement with said tool string for minimizing bending forces from being applied to the tool string during rotation, said bending forces being due to misalignment between the axis of the tool string and the axis about which driving forces are normally centered.

16. An apparatus according to claim 15 wherein said connecting means comprises a carriage, track means for supporting the carriage for longitudinal movement along a path, a parallelogram linkage connecting said power means to said carriage, and a hydraulic cylinder and piston unit connected between the vehicle and said parallelogram linkage and placed in a freely moving neutral position during rotation of said tool string, misalignment of said gripping means in a direction parallel to the longitudinal path being accommodated by free movement of said hydraulic unit while misalignment transversely of said path being accommodated by said parallelogram linkage.

17. An apparatus according to claim 15 wherein said gripping means includes a ratchet secured to the pipe string for rotation therewith and including ratchet teeth, and a pair of ratchet pawls pivotally attached to an apertured disc and engageable with the ratchet teeth.

18. An apparatus according to claim 17 wherein said power means comprises a pair of hydraulic cylinders, a pair of piston rods in said cylinders, means pivotally connecting the cylinders to the vehicle, means pivotally connecting the piston rods to diametrically opposed portions of said disc, a first conduit interconnecting the high pressure ends of said cylinders to equalize the pressure in each cylinder when rotating the tool string, a second conduit connected to said first conduit and having high pressure fluid therein, a valve in said second conduit movable between an open and a closed position, a pair of switch means connected in parallel to said valve and actuated to close the valve in response to the first piston rod moving relative to its cylinder through a predetermined distance, misalignment in a direction parallel to the piston rods being accommodated by the different distances which said piston rods move relative to their associated cylinders, misalignment in a direction transverse of the piston rods being accommodated by said means pivotally connecting the cylinders to the vehicle.

19. In a subterranean drilling and mining apparatus including a tool string, a mining head comprising: means defining an outer conduit section having an upper portion and a lower portion, a swivel joint connecting said lower portion to said upper portion for relative rotation therebetween, releasable lock means for selectively locking said portions together or for releasing said portions for relative rotation, and a liquid inlet conduit connected to the upper conduit portion for directing high pressure liquid into said outer conduit; means defining an inner conduit section including a slotted lower end defining a portion for establishing a stab connection with and non-rotatable relative to the inner pipe section of the tool string, means for centering and holding the inner conduit section from axial movement relative to said outer section, a slurry discharge elbow secured to the upper portion of the outer pipe section adjacent the upper end of the inner pipe section; and means defining a fluid sealing gland between the upper end of said inner conduit section and said outer conduit section for permitting relative rotation between the outer conduit section and the inner conduit section.

20. An apparatus according to claim 19 wherein said outer conduit section additionally includes threaded coupling means on the upper end of the outer conduit section for receiving power driven means for rotating said head, and screw threads means on the lower end of the lower portion for establishing a threaded connection with the outer section of a tool string.

21. An apparatus according to claim 19 and additionally comprising a control line section connected to the external surface of said inner conduit section; connecting means on the lower end of said control line section for establishing a stab connection with and non-rotatable relative to a control line of the tool string section; and means connecting the upper end of said control line section to said fluid sealing gland for communication with passage defining means opening to the atmosphere outside of the outer conduit section; said fluid sealing gland being arranged to preclude mixing of liquid in said outer conduit section, said inner conduit section, and said control conduit section.

22. An apparatus according to claim 21 wherein said outer conduit section additionally includes threaded coupling means on the upper end of the outer conduit section for receiving power driven means for rotating said head, and screw thread means on the lower end of the lower portion of said outer conduit section for establishing a threaded connection with the outer section of the tool string therebelow.

* * * * *

UNITED STATES PATENT OFFICE

CERTIFICATE OF CORRECTION

Patent No. 4,106,575 Dated August 15, 1978

Inventor(s) PHILIP R. BUNNELLE

It is certified that error appears in the above-identified patent and that said Letters Patent are hereby corrected as shown below:

Column 9, line 58, change "educator" to --eductor--.

Column 13, line 12, change "apparatus" to --apparent--.

Signed and Sealed this

*Eighteenth* Day of *September 1979*

[SEAL]

*Attest:*

*Attesting Officer*

LUTRELLE F. PARKER

*Acting Commissioner of Patents and Trademarks*